US006192213B1

(12) United States Patent
Wada et al.

(10) Patent No.: US 6,192,213 B1
(45) Date of Patent: Feb. 20, 2001

(54) DOUBLE-SIDE PRINTING APPARATUS

(75) Inventors: Yoshinori Wada, Kawasaki; Katsumi Adachi, Kato-gun, both of (JP)

(73) Assignee: Fujitsu Limited, Kanagawa (JP)

( * ) Notice: Under 35 U.S.C. 154(b), the term of this patent shall be extended for 0 days.

(21) Appl. No.: 09/422,858

(22) Filed: Oct. 25, 1999

(30) Foreign Application Priority Data

Apr. 15, 1999 (JP) ..... 11-108233

(51) Int. Cl.[7] ..... B41J 3/60; G03G 15/00; G03G 15/20

(52) U.S. Cl. ..... 399/306; 399/322; 399/336; 399/341; 399/384

(58) Field of Search ..... 399/306, 322, 399/336, 364, 384, 397, 400, 327, 341; 101/190, 229

(56) References Cited

U.S. PATENT DOCUMENTS

| | | | | |
|---|---|---|---|---|
| 5,659,865 | * | 8/1997 | Zarbo | 399/327 |
| 5,678,153 | * | 10/1997 | Okamoto et al. | 399/327 |
| 5,765,081 | * | 6/1998 | Bogaert et al. | 399/299 |
| 5,835,836 | * | 11/1998 | Hirao | 399/336 |
| 6,118,956 | * | 9/2000 | Hirao | 399/306 X |

FOREIGN PATENT DOCUMENTS 07077851 3/1995 (JP) .

08211664 8/1996 (JP) .

* cited by examiner

*Primary Examiner*—Sophia S. Chen
(74) *Attorney, Agent, or Firm*—Armstrong, Westerman, Hattori, McLeland and Naughton, LLP

(57) ABSTRACT

A double-side printing apparatus for printing on double surfaces of a recording medium is constructed to prevent both an adverse influence on an image forming unit from a fixing unit and an offset of a toner image on the recording medium. The double-side printing apparatus includes a first image forming unit for forming the toner image on one surface of the recording medium, a second image forming unit, provided downstream of the first image forming unit, for forming a toner image on the other surface of the recording medium, a first fixing unit for fixing the toner image on one surface of the recording medium by a light, a second fixing unit, provided downstream of the first fixing unit, for fixing the toner image on the other surface of the recording medium, and a preventing member, provided between the first fixing unit and the second image forming unit, for preventing the light from the first fixing unit from reaching a photo sensitive body of the second image forming unit. The double-side printing apparatus further includes a guide member for guiding the recording medium, and a charger for charging the recording medium to prevent an offset of an unfixed image to the guide member.

23 Claims, 6 Drawing Sheets

DOUBLE-SIDE PRINTING APPARATUS

BACKGROUND OF THE INVENTION

1. Field of the Invention

The present invention relates generally to a double-side printing apparatus for printing on double sides of a recording medium and, more particularly, to a double-side printing apparatus in which a plurality of electrophotographic recording units are disposed.

2. Related Background Art

A printing apparatus has been widely utilized as an output apparatus of a computer. An electrophotographic apparatus capable of printing on an ordinary sheet of paper has been utilized as the printing apparatus. In response to a demand for saving natural resources in recent years, a double-side printing apparatus for printing on double sides of the sheet has been required. Then, an apparatus provided with both a printing mechanism for printing on the right side of the recording medium and a printing mechanism for printing on the reverse side of the recording medium, is required for increasing printing speed.

FIG. 7 is an explanatory view showing the prior art.

The double-side printing apparatus includes an electrophotographic printing unit (a second image forming unit) 91 for printing on the right side of a sheet of recording paper P, and an electrophotographic printing unit (a first image forming unit) 92 for printing on the reverse side of the sheet P. The sheet P is classified as continuous paper perforated to delimit each page. The reverse side printing unit 92 has a photosensitive drum. The photosensitive drum is charged by a pre-charger and thereafter exposed to a light image by an exposing unit. An electrostatic latent image corresponding to the light image is thereby formed on the photosensitive drum. The latent image on the photosensitive drum is developed by a developing unit. Then, the developed image on the photosensitive drum is transferred onto the sheet P by a transferring unit. Thus, the image is printed on the reverse side of the sheet P.

The printing on the right side of the sheet P is likewise performed. To be specific, the right side printing unit 91 has a photosensitive drum. The photosensitive drum is charged by a pre-charger and thereafter exposed to a light image by an exposing unit. An electrostatic latent image corresponding to the light image is thereby formed on the photosensitive drum. The latent image on the photosensitive drum is developed by a developing unit. Subsequently, the developed image on the photosensitive drum is transferred onto the sheet P by a transferring unit. Thus, the image is printed on the right side of the sheet P.

Next, a toner image on the reverse side of the recording sheet P is fixed by a first fixing unit 93. Then, a toner image on the right side of the recording sheet P is fixed by a second fixing unit 94. Thus, according to the described double-side printing process, after the toner image has been formed on the right side, the toner image is formed on the reverse side. And then a fixing process is performed, thereby the double-side printing apparatus can be downsized. This type of double-side printing apparatus for printing on the continuous paper is disclosed in Japanese Patent Application Laid-Open Publication Nos.7-77851 and 8-211664.

There arise, however, the following problems inherent in the prior art.

First, if flash fixing units for fixing by a flash light are used as the fixing units 93, 94, the image can be fixed in a non-contact manner onto the sheet. Therefore, even when unfixed images are fixed by continuous feeding, it never happens that the unfixed images are disturbed. The flash has, however, a high intensity, and hence leaked flash beams strike upon the photosensitive drum of the electrophotographic printing unit, resulting in such a problem that the photosensitive drum might be deteriorated. Especially, the flash beams from the first fixing unit 93 impinge on the photo sensitive drum of the second electrophotographic printing unit 91 through the sheet P, and the problem is also the deterioration of this photosensitive drum.

Second, it is necessary for stabilizing the carry of the sheet that a guide member is provided between the first fixing unit and the second electrophotographic printing unit 91. The guide member is, however, brought into contact with the unfixed image on the sheet, and consequently the toner image is offset by the guide member, with the result that the disturbance of the unfixed image on the sheet might occur as another problem.

SUMMARY OF THE INVENTION

It is a primary object of the present invention to provide a double-side printing apparatus capable of preventing a deteoritation of a photo conductive body of an image forming unit even when a fixing unit by a light is used as a fixing unit.

It is an another object of the present invention to provide a double-side printing apparatus capable of preventing a disturbance of an unfixed image even when providing a guide member.

To accomplish the above object, according to a first aspect of the present invention, a double-side printing apparatus for printing on double surfaces of a recording medium, comprises a first image forming unit for forming a toner image on one surface of the recording medium, a second image forming unit, provided downstream of the first image forming unit and including a photo conductive body for forming a toner image on the other surface of the recording medium, a first fixing unit for fixing the toner image on one surface of the recording medium by a light, a second fixing unit, provided downstream of the first fixing unit, for fixing the toner image on the other surface of the recording medium, and a preventing member, provided between the first fixing unit and the second image forming unit, for preventing the light of the first fixing unit from reaching the photo conductive body of the second image forming unit.

In the double-side printing apparatus according to the first aspect of the invention, the preventing member for cutting off the light from the first fixing unit is provided between the closest second image forming unit and the first fixing unit. Therefore, even when the first fixing unit is provided with the flash fixing unit for fixing by use of the flash, it is feasible to prevent the flash from impinging upon the photosensitive body of the second image forming unit. The photosensitive body of the image forming unit can be thereby prevented from being deteriorated.

According to a second aspect of the invention, the preventing member is constructed of a guide roller for guiding the recording medium. With this contrivance, the preventing member guides the recording medium, and hence the recording medium can be guided with a stability between the first fixing unit and the second image forming unit. Further, even when a non-contact type fixing unit is provided as the first fixing unit, the recording medium can be stably carried.

According to a third aspect of the invention, the guide roller contacts with the other surface of the recording medium.

According to a fourth aspect of the invention, the guide roller rotates at the same speed as a carrying speed of the recording medium.

According to a fifth aspect of the invention, the double-side printing apparatus further comprises a cleaning member for cleaning the guide roller.

According to a sixth aspect of the invention, a double-side printing apparatus comprises a first image forming unit for forming a toner image on one surface of the recording medium, a second image forming unit, provided downstream of the first image forming unit, for forming a toner image on the other surface of the recording medium, a first fixing unit for fixing the toner image on one surface of the recording medium, a second fixing unit, provided downstream of the first fixing unit, for fixing the toner image on the other surface of the recording medium, a guide member, provided between the first fixing unit and the second image forming unit, for guiding the recording medium, and a charger for charging the recording medium to prevent an offset of an unfixed image to the guide member.

In the double-side printing apparatus according to the sixth aspect of the invention, the guide member for guiding the recording medium is provided between the fixing unit and the image forming unit. With this arrangement, it is possible to stabilize the carrying of the recording medium in the fixing unit. Next, the guide member comes into contact with the unfixed image on the recording medium, and the unfixed image might therefore be adhered to the guide member. Accordingly, the charger is provided for attracting the unfixed toner image on the recording medium, to the recording medium, thereby preventing the unfixed image on the recording medium from being adhered to the guide member.

According to a seventh aspect of the invention, the charger applies to the recording medium an electric charge having an opposite polarity to a polarity of the toner image on the recording medium.

According to an eighth aspect of the invention, a set value of a charging current of the charger falls within a range of 200 $\mu$A to 1200 $\mu$A.

According to a ninth aspect of the invention, the double-side printing apparatus further comprises a control unit for controlling the set value of the charger in accordance with an ambient environment or a thickness of the recording medium or a development condition.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principle of the invention, in which.

DESCRIPTION OF THE PREFERRED EMBODIMENTS

Figure 1:
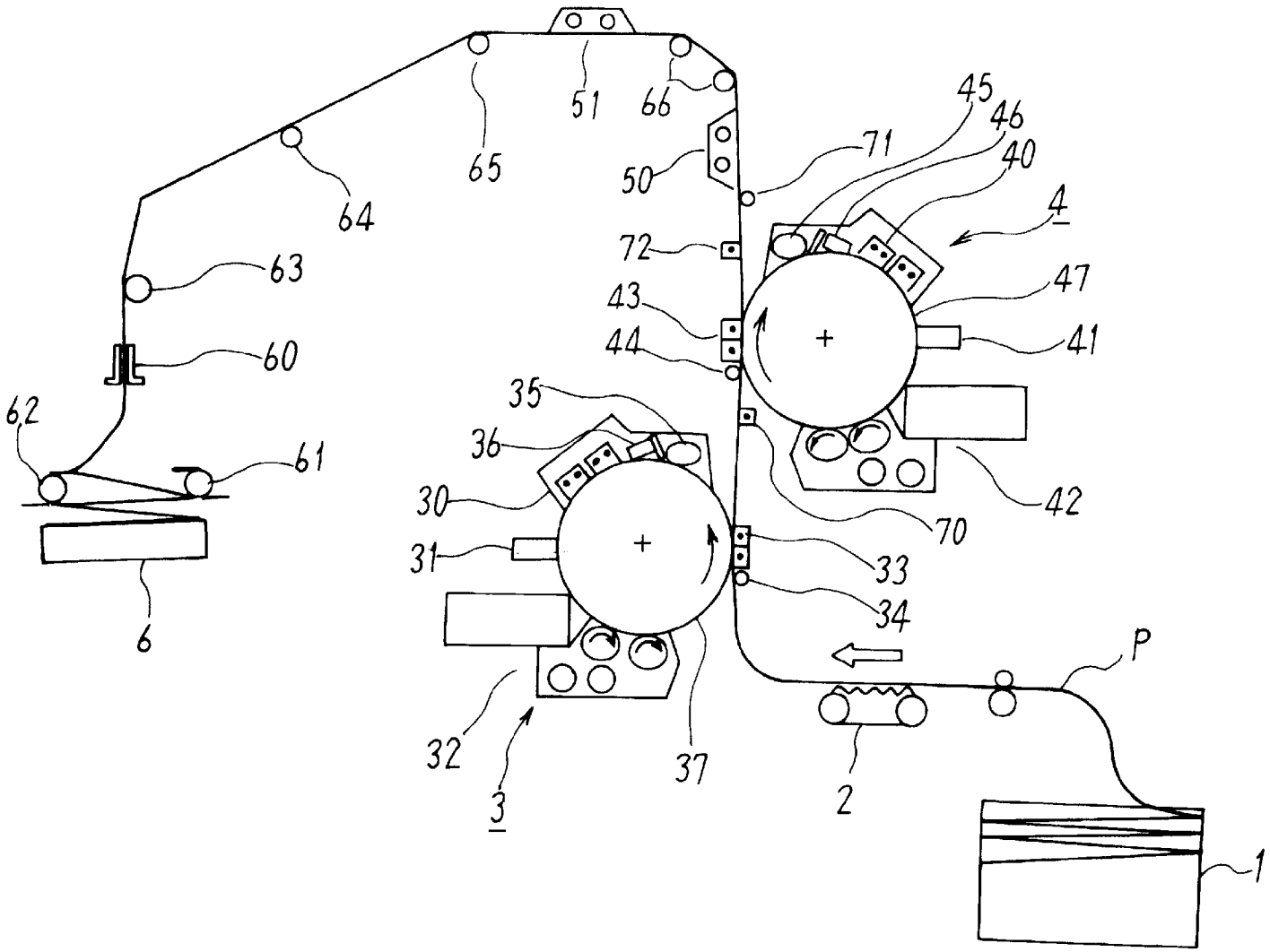
FIG. 1 is a view showing a construction of a double-side printing apparatus in one embodiment of the present invention.
Figure 2:
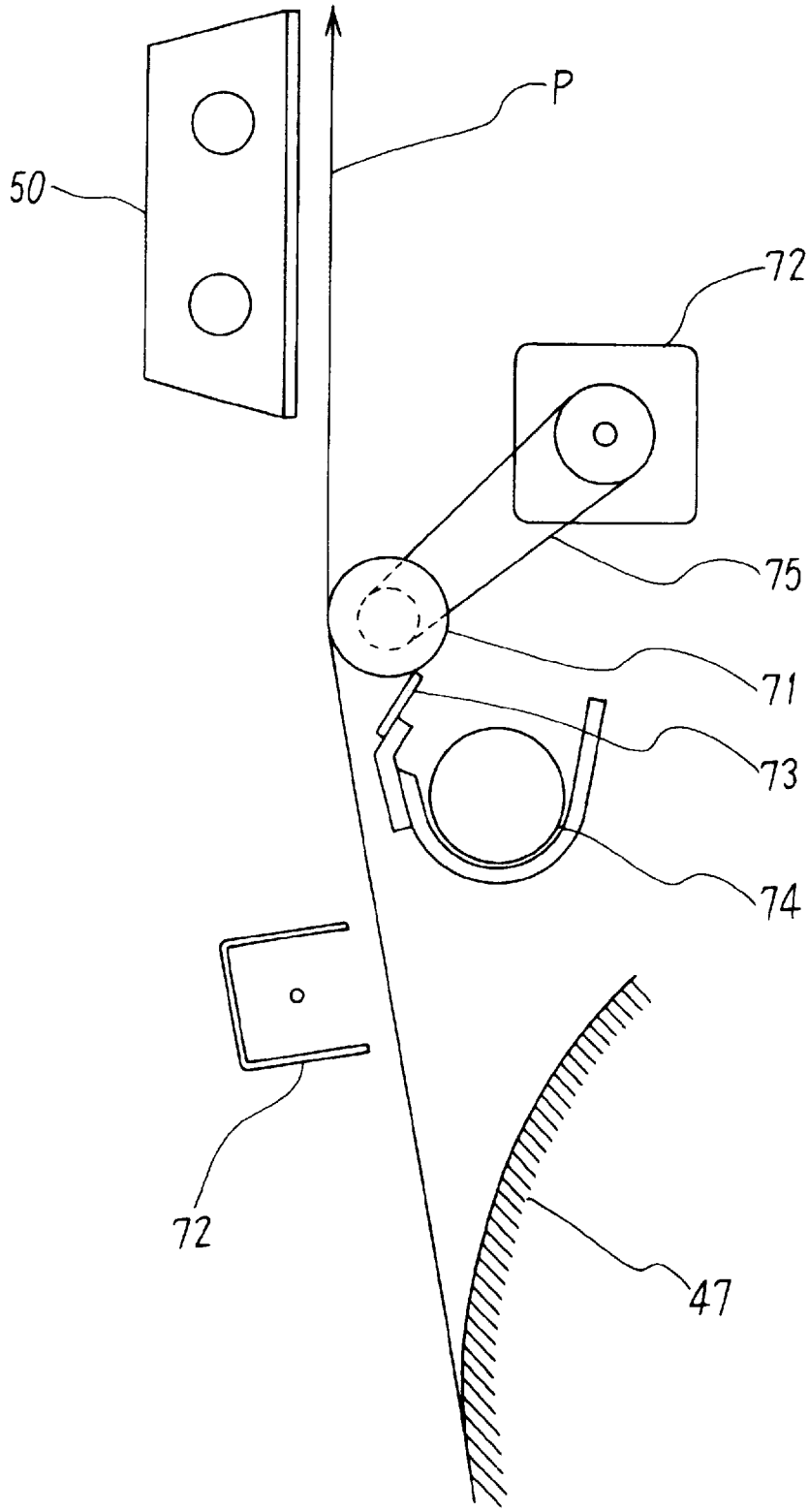
FIG. 2 is a partial enlarged view in the construction in FIG. 1.

FIG. 1 is a view showing a construction of a double-side printing apparatus in one embodiment of the present invention. FIG. 2 is an enlarged view of a part of the construction in FIG. 1.

FIG. 1 illustrates the double-side printing apparatus for effecting prints on double sides of a continuous sheet having feed perforations. A hopper 1 is stacked with unprinted continuous sheet P. The continuous sheet P is perforated to delimit each page. A sheet carrier tractor 2 engages with the feed perforations of the continuous sheet P and thus carries the continuous sheet P in an arrow direction. A reverse side printing mechanism (a first image forming unit) 3 is constructed of an electrophotographic printing mechanism, and effects printing on the reverse side of the continuous sheet P.

This reverse side printing mechanism 3 includes a photosensitive drum 37, a charging unit 30 for charging the photosensitive drum 37, and an LED head 31 for exposing the photosensitive drum 37 to a one-line light image. This LED head 31 is composed of an LED array where LEDs (light emitting diodes), of which the number is set corresponding to one line, are arrayed.

A developing unit 32 develops a latent image on the photosensitive drum 37. The developing unit 32 is constructed of a double-component developing unit for developing with a double-component developer. A transfer charging unit 33 transfers, onto the continuous sheet P, the developed image on the photosensitive drum 37. A transfer guide roller 34 presses the continuous sheet P against the photosensitive drum 37 when in a transfer process. A cleaner 35 collects residual toners on the photosensitive drum 37. A de-electrifying lamp 36 removes a residual potential out of the photosensitive drum 37.

A right side printing mechanism (a second image forming unit) 4 is also composed of an electrophotographic printing mechanism, and implements the printing on the right side of the continuous sheet P. The right side printing mechanism 4 is disposed downstream of the reverse side printing mechanism 3 in a sheet carrying direction.

This right side printing mechanism 4 includes a photosensitive drum 47, a charging unit 40 for charging the photosensitive drum 47 with electricity, and an LED head 41 for exposing the photosensitive drum 47 to a one-line light image. This LED head 41 is composed of an LED array where LEDs (light emitting diodes), of which the number is set corresponding to one line, are arrayed.

A developing unit 42 develops the latent image on the photosensitive drum 47. A developing unit 42 is constructed of a double-component developing unit for developing with the double-component developer. A transfer charging unit 43 transfers, onto the continuous sheet P, the developed image on the photosensitive drum 47. A transfer guide roller 44 presses the continuous sheet P against the photosensitive drum 47 when in the transfer process. A cleaner 45 collects residual toners on the photosensitive drum 47. A de-electrifying lamp 46 removes a residual potential out of the photosensitive drum 47.

A neutralization charging unit 70 is provided between the reverse side printing mechanism 3 and the right side printing mechanism 4, and neutralizes an electric potential on the right side of the continuous sheet P assuming the electric potential through the reverse side printing mechanism 3. The transferring operation can be thereby performed with a stability in the right side printing mechanism 4.

A guide roller 71 is provided to stabilize a behavior of the sheet P between the right side printing mechanism 4 and the fixing units 50 and 51. The guide roller 71 is provided on the side of the photosensitive drum 47 of the right-side printing mechanism 4. The guide roller 71 therefore guides the sheet and prevents the light of the fixing unit 50 from impinging upon the photosensitive drum 47.

A charger 72 is provided between the right side printing mechanism 4 and the guide roller 71, and applies to the sheet P an electric charge exhibiting a polarity opposite to that of the electric charge of the toner image on the sheet P. A force of constraint of the unfixed toner image with respect to the sheet P is thereby amplified. This makes it feasible to prevent the unfixed image on the sheet P from being offset-adhered to the guide roller 71.

The fixing unit is constructed of a pair of flash fixing units 50, 51. The first flash fixing unit 50 is provided on the reverse side of the sheet P, and fixes the toner image on the reverse side of the sheet P by the flash light. The second flash fixing unit 51 is provided on the right side of the sheet P, and fixes the toner image on the right side of the sheet P by the flash light. A folding roller 66 for folding the sheet P is provided between the flash fixing units 50 and 51.

A stacker 6 is stacked with the printed continuous sheets P. Scuff rollers 63, 64, 65 guide the sheet P to the stacker 6 from the fixing unit. A swing guide 60 swings to assist the folding of the sheet P. Impellers 61, 62 assist the folding of the sheet P.

In this double-side printing apparatus, the reverse side printing mechanism 3 starts printing in advance of the right side printing mechanism 4 when in the double-sides printing. Further, a carrying path is set in a vertical direction, and the reverse and right side printing mechanisms 3, 4 are provided with this carrying path interposed therebetween. The double-side printing apparatus can be therefore downsized.

FIG. 2 is the partially enlarged view showing the guide roller 71.

The guide roller 71 is provided on the right side of the sheet P and is rotatable. This guide roller 71 guides the sheet P from the photosensitive drum 47 of the right side printing mechanism 4. The guide roller 71 is provided in such a position as to stabilize the behavior of the sheet P in the flash fixing unit 50 on the reverse side of the sheet. Further, the guide roller 71 is also disposed in such a position as to prevent the flash light from the flash fixing unit 50 from impinging upon the photosensitive drum 47.

The guide roller 71 is rotated through a belt 75 by a motor 76. A rotating direction of the guide roller 71 is identical with the carrying direction of the sheet P. Further, a rotating velocity of the guide roller 71 is approximately the same as a carrying velocity of the sheet P. Hence, the guide roller 71 does not become a resistance against the carrying of the sheet P. Accordingly, the unfixed toner image on the sheet P is never disturbed by the guide roller 71. Further, the unfixed toner image can be prevented from being offset-adhered to the guide roller 71.

A cleaning blade 73 scrapes off the toners adhered to the guide roller 71. A collecting screw 74 collects the toners scraped off by the cleaning blade 73. Thus, the cleaning member for the guide roller 71 is provided, and therefore, even when the toners on the sheet are adhered to the guide roller 71, the toners adhered to the guide roller 71 can be scraped off. Consequently, even when the guide roller 71 guides the sheet with the unfixed toner image, it is feasible to prevent the toner image from being re-transferred onto the sheet P from the guide roller 71. The disturbance of the unfixed image on the sheet P can be therefore prevented.

Furthermore, the charger 72 is provided on the opposite side to the side of the guide roller 71, with the sheet P being sandwiched in therebetween, in a position just anterior to the guide roller 71. The charger 72 applies the electric charge having the polarity opposite to that of the electric charge of the toner image on the sheet P. The force of constraint of the unfixed toner image with respect to the sheet can be thereby increased on the surface of the sheet P. It is therefore possible to prevent the unfixed toner image on the surface of the sheet P from being offset to the guide roller 71.

Moreover, the surface of the guide roller 71 is covered with a low-friction material (e.g., a fluororesin). With this contrivance, the resistance against the sheet can be thereby reduced. It is therefore feasible to prevent the unfixed toner image from being offset to the guide roller 71. A life-span of the guide roller 71 can be also elongated.

Figure 3:
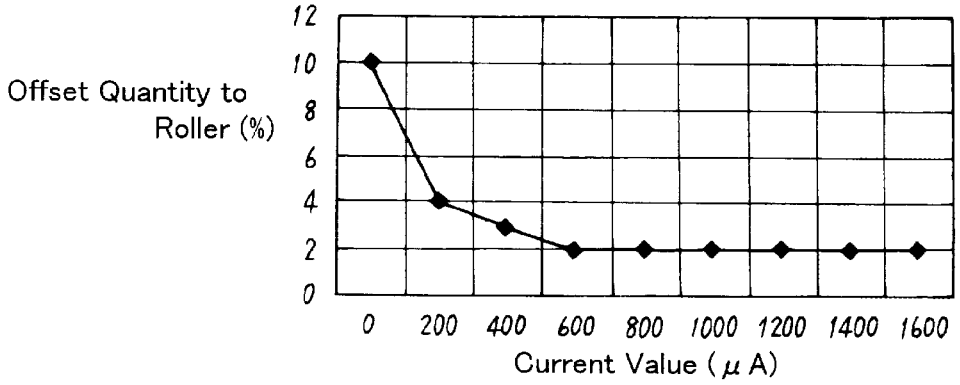
FIG. 3 is a characteristic diagram showing an offset quantity of a charger in FIG. 1.
Figure 4:
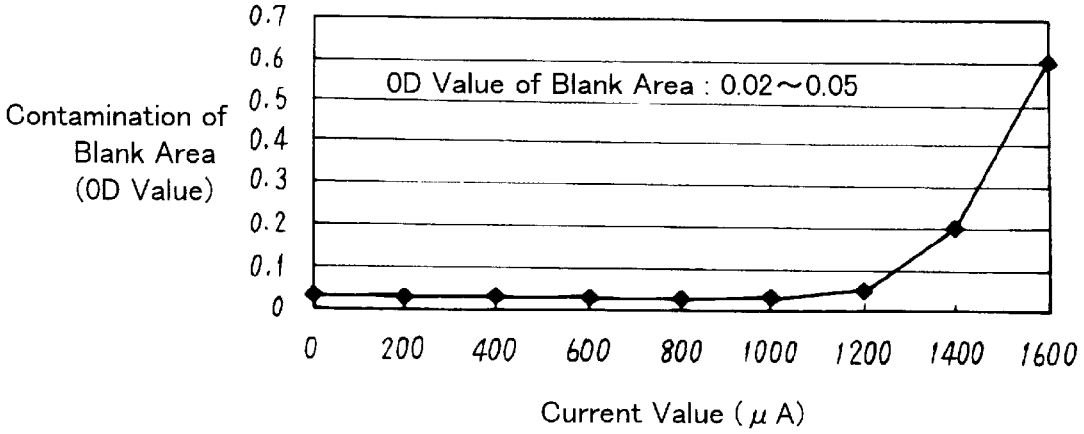
FIG. 4 is a characteristic diagram showing an Optical Density (OD) value of the charger in FIG. 1.

Next, an optimum value of the charging current of the charger 72 will be explained. FIG. 3 is a characteristic diagram of an offset quantity. FIG. 4 is a characteristic diagram of an Optical Density (OD) value.

FIG. 3 shows what the offset quantity of the guide roller 71 is measured when the charging current changes from 0 $\mu$A to 1600 $\mu$A in the construction in FIG. 2. Namely, in the construction in FIG. 2, the sheet bearing a predetermined quantity of toner images is carried. Then, a quantity of the toner adhered to the guide roller 71 with respect to each charging current value, is measured by varying the charging current value of the charger 72.

Then, the measured toner quantity is divided by a predetermined quantity, and thus indicated in percentage. It has proved from a result of this measurement that the offset quantity is as much as 10% when the charging current value is 0 $\mu$A. The offset quantity is decreased down to 4% when the charging current value is 200 $\mu$A. The offset quantity thereafter decreases likewise as the charging current value increases.

It has proven from this result that the rise in the charging current value over 200 $\mu$A contributes to reduce the offset quantity.

FIG. 4 shows what a contamination on a blank area of the sheet is measured when the charging current changes from 0 $\mu$A to 1600 $\mu$A in the construction in FIG. 2. Namely, in the construction in FIG. 2, the sheet bearing the toner images is carried. Then, an OD (Optical Density) on the blank area of the sheet with respect to each charging current value, is measured by varying the charging current value of the charger 72.

It has proven from a result of this measurement that the D value of the blank area is substantially the same as a state of the complete blank when the charging current value is 0 $\mu$A to 1200 $\mu$A. When the charging current value is 1400 $\mu$A or more, it is indicated that the OD value of the blank area rises. If the charging current value is large, it can be presumed that the toner image on the sheet might be disturbed enough to over-transfer the toner onto the blank area.

As a result of this, it has proven that when the charging current value is under 1200 $\mu$A, no change in the OD value of the blank area is seen.

It has been demonstrated from the results in FIGS. 3 and 4 that when the charging current value falls within a range of 200 μA through 1200 μA, the offset to the guide roller 71 can be prevented without disturbing the toner image.

Given next is an explanation of how the charging current value of the charger is controlled.

Figure 5:
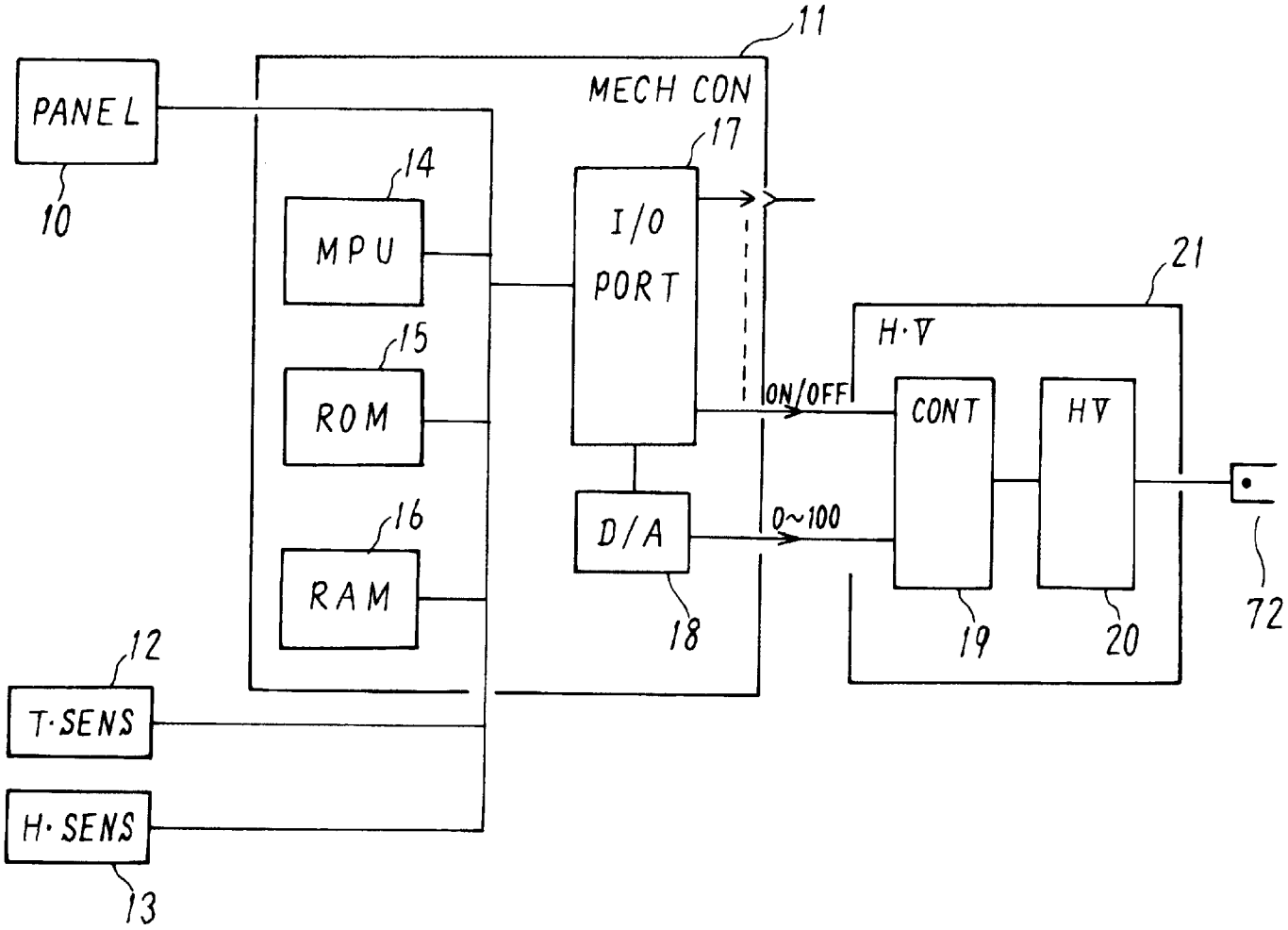
FIG. 5 is a control block diagram of the charger in FIG.

FIG. 5 is a block diagram in one embodiment of the present invention. Referring to FIG. 5, an operator indicates an operation through a panel 10. A thickness (a consecutive quantity) of the sheet is inputted from the panel 10. A temperature detector 12 detects a temperature of the apparatus. A humidity detector 13 detects a humidity of the apparatus. A mechanism control unit 11 controls the respective units of the apparatus in accordance with an indications given from a whole control unit (unillustrated) as well as from the panel 10. The mechanism control unit 11 includes a MPU 14, a ROM 15, a RAM 16, an I/O port 17 and a D/A converter 18.

A high voltage control unit 21 controls a charging voltage applied to the charger 72 in accordance with an indication given from the mechanism control unit 11. The high voltage control unit 21 includes a high voltage controller 19 for receiving an ON/OFF indication from the I/O port 17 and a control quantity from a D/A converter 18, and controlling a voltage value of a high voltage power supply 20.

In this embodiment, the MPU 14 of the mechanism control unit 11 changes the charging voltage of the charger 72 in accordance with a sheet thickness indication given from the panel 10. For example, when the sheet thickness is small, the charging voltage is decreased. When the sheet thickness is large, the charging voltage is increased.

Further, the MPU 14 changes the charging voltage of the charger 72 in accordance with the detected temperature given from the temperature detector 12. For instance, when the temperature is low, the charging voltage is increased. When the temperature is high, the charging voltage is decreased.

Similarly, the MPU 14 changes the charging voltage of the charger 72 in accordance with the detected humidity given from the humidity detector 13. For example, when the humidity is low, the charging voltage is increased. When the humidity is high, the charging voltage is decreased.

Thus, the charging voltage of the charger 72 is controlled corresponding to the ambient environment and the thickness of the sheet. Therefore, the charging voltage value can be set to an optimum value corresponding to the ambient environment and the thickness of the sheet.

Furthermore, the electric potential of the toner image on the sheet might change depending on developing conditions, such as a surface potential of the photosensitive drum, exposure power, a toner density, a developing bias voltage and a transfer current etc. Corresponding to this, the MPU 14 receives set values of the developing conditions and may control the set value of the charging voltage of the charger 72.

Figure 6:
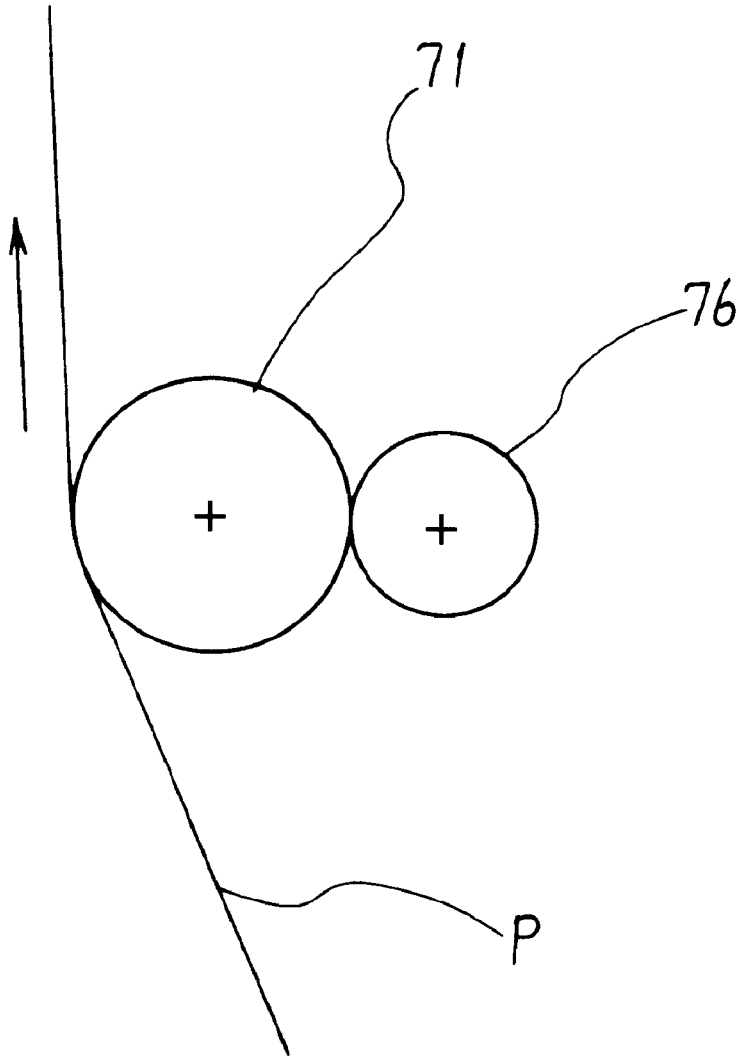
FIG. 6 is view showing a construction in another embodiment of the present invention.
Figure 7:
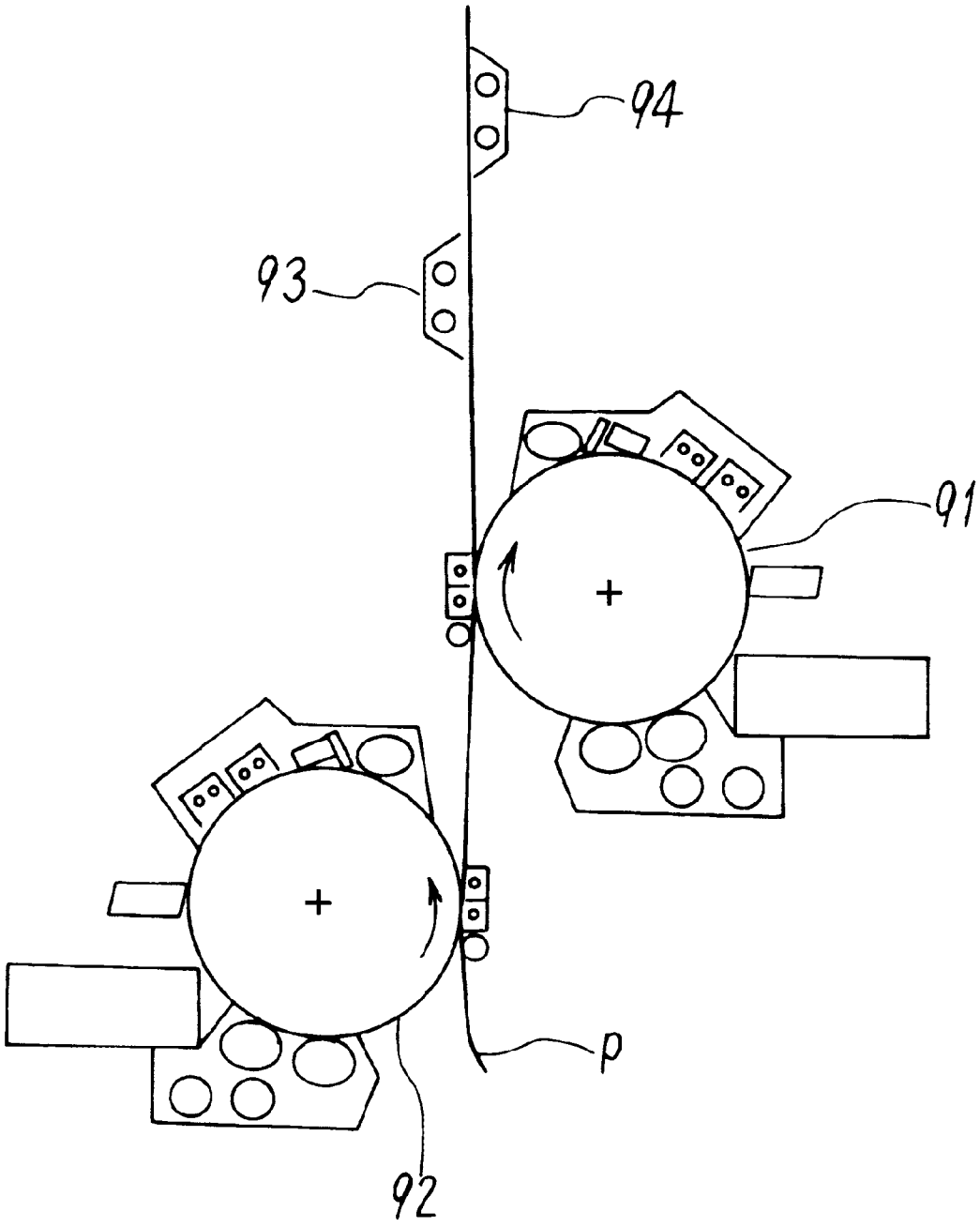
FIG. 7 Prior Art
FIG. 7 is an explanatory diagram of the prior art.

FIG. 6 is a diagram of a construction in another embodiment of the present invention, showing another mode of the guide roller.

Referring to FIG. 6, the guide roller 71 is classified as a roller rotationally driven following up the sheet with which the roller 71 is brought into contact. A cleaning roller 77 removes the toners adhered to the guide roller 71.

In this embodiment, the guide roller 71 rotates substantially at the same rotating speed as that of the sheet P while being rotated following up the sheet P, and does not therefore become a resistance against the carrying of the sheet. Accordingly, the offset of the toner image on the sheet can be prevented. Further, the cleaning roller 77 cleans the toners off the guide roller 71, and hence the toners adhered to the guide roller 71 can be thus removed.

An abrasion maintenance of the guide roller 71 may involve referring to contents of, e.g., a drum counter for measuring a rotating time of the photosensitive drum and of a print charge counter for managing the number of prints. Then, with reference to these contents, when the rotating time of the guide roller 71 comes to a desired value, an exchange message is displayed to prompt the user to replace it.

In addition to the embodiments discussed above, the present invention may also be modified as follows:

(1) The electrophotographic mechanism using the photosensitive drum has been exemplified as a printing mechanism, however, there may also be applied printing mechanism for forming the toner images by use of other photosensitive bodies.

(2) The flash fixing unit has been exemplified as a fixing unit, however, other fixing units, such as a heat roller fixing unit, etc, may also be used.

The present invention has been discussed so far by way of the embodiments but may be modified in a variety of forms within the range of the gist of the present invention, and those modifications are not excluded from the scope of the present invention.

As discussed above, the present invention exhibits the effects which follow.

(1) When fixing the toner images on the right and reverse sides, the preventing member is provided between the closest second image forming unit and the first fixing unit. Therefore, even when the first fixing unit is provided with the flash fixing unit for fixing by use of the flash, it is feasible to prevent the flash light from impinging upon the photosensitive body of the second image forming unit. The photosensitive body of the image forming unit can be thereby prevented from being deteriorated.

(2) Further, the guide member for guiding the recording medium is provided between the fixing unit and the image forming unit. With this arrangement, it is possible to stabilize the carrying of the recording medium in the fixing unit. The charger is provided for attracting the unfixed toner image on the recording medium, thereby preventing the unfixed image on the recording medium from being adhered to the guide member.

What is claimed is:

1. A double-side printing apparatus for printing on double surfaces of a recording medium, comprising:

a first image forming unit for forming a toner image on one surface of said recording medium;

a second forming unit, provided downstream of said first image forming unit and including a photo conductive body, for forming a toner image on the other surface of said recording medium;

a first fixing unit for fixing the toner image on one surface of said recording medium by a light;

a second fixing unit, provided downstream of said first fixing unit, for fixing the toner image on the other surface of said recording medium;

a preventing member, provided between said first fixing unit and said second image unit, for preventing the light from said first fixing unit from reaching said photo conductive body of said second image forming unit;

a folding roller provided between said first fixing unit and said second fixing unit and folding back said recording medium from said first fixing unit to said second fixing unit, and wherein said preventing member is provided on only a side of the other surface of said recording medium.

2. The double-side printing apparatus according to claim 1, wherein said first fixing unit is comprised of a flash fixing unit.

3. The double-side printing apparatus according to claim 1, wherein said recording medium is comprised a continuous medium.

4. The double-side printing apparatus according to claim 1, wherein said photo conductive body and said preventing member are arranged at the other surface side of said recording medium, and said first fixing unit is arranged at the one surface side of said recording medium.

5. The double-side printing apparatus according to claim 1, wherein said preventing member is constructed of a guide member for guiding said recording medium.

6. The double-side printing apparatus according to claim 5, wherein said guide member is comprised of a rotary guide roller.

7. The double-side printing apparatus according to claim 6, wherein said rotary guide roller rotates at the same speed as a carrying speed of said recording medium.

8. The double-side printing apparatus according to claim 7, further comprising a motor for rotating said rotary guide roller.

9. The double-side printing apparatus according to claim 6, further comprising a cleaning member for cleaning said rotary guide roller.

10. The double-side printing apparatus according to claim 5, wherein said guide member contacts with said other surface of said recording medium.

11. A double side printing apparatus for printing on double surf aces of a recording medium, comprising:

a first image forming unit for forming a toner image on one surface of said recording medium;

a second image forming unit, provided downstream of said first image forming unit, for forming a toner image on the other surface of said recording medium;

a first fixing unit for fixing the toner image on one surface of said recording medium;

a second fixing unit, provided downstream of said first fixing unit, for fixing the toner image on the other surface of said recording medium;

a guide member , provided between said first fixing unit and said second image forming unit, for guiding said recording medium; and a charger for charging said recording medium to prevent an offset of an unfixed image to said guide member.

12. The double-side printing apparatus according to claim 11, wherein said charger applies to said recording medium an electric charge having an opposite polarity to a polarity of the toner image on said recording medium.

13. The double-side printing apparatus according to claim 11, wherein a set value of a charging current of said charger falls within a range of 200 $\mu$A to 1200 $\mu$A.

14. The double-side printing apparatus according to claim 11, further comprising a control unit for controlling a set value of said charger in accordance with an ambient environment.

15. The double-side printing apparatus according to claim 11, further comprising a control unit for controlling a set value of said charger in accordance with a thickness of said recording medium.

16. The double-side printing apparatus according to claim 11, further comprising a control unit for controlling a set value of said charger in accordance with a developing condition of said first and second image forming units.

17. The double-side printing apparatus according to claim 11, wherein said guide member is comprised of a rotary guide roller.

18. The double-side printing apparatus according to claim 17, wherein said rotary guide roller is provided on the other surface of said recording medium, and said charger is provided on the one surface side of said recording medium.

19. The double-side printing apparatus according to claim 17, wherein said rotary guide roller rotates at the same speed as a carrying speed of said recording medium.

20. The double-side printing apparatus according to claim 19, further comprising a motor for rotating said rotary guide roller.

21. The double-side printing apparatus according to claim 17, further comprising a cleaning member for cleaning said rotary guide roller.

22. The double-side printing apparatus according to claim 17, wherein said rotary guide roller has a low-friction material surface.

23. The double-side printing apparatus according to claim 17, wherein said first fixing unit is comprised of a flash fixing unit.

* * * * *